US009915163B2

(12) United States Patent
McCaffrey

(10) Patent No.: US 9,915,163 B2
(45) Date of Patent: Mar. 13, 2018

(54) CAM-FOLLOWER ACTIVE CLEARANCE CONTROL

(71) Applicant: United Technologies Corporation, Hartford, CT (US)

(72) Inventor: Michael G. McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 584 days.

(21) Appl. No.: 14/713,686

(22) Filed: May 15, 2015

(65) Prior Publication Data

US 2016/0333721 A1 Nov. 17, 2016

(51) Int. Cl.

| | |
|---|---|
| ***F01D 11/22*** | (2006.01) |
| ***F01D 25/28*** | (2006.01) |
| ***F01D 5/12*** | (2006.01) |

(52) U.S. Cl.

CPC ..... *F01D 11/22* (2013.01)

(58) Field of Classification Search

CPC ..... F01D 11/14; F01D 11/20; F01D 11/22; F04D 27/002; F04D 27/0246; F04D 29/323; F04D 29/326; F04D 29/36; F04D 29/642

See application file for complete search history.

(56) References Cited

U.S. PATENT DOCUMENTS 3,085,398 A * 4/1963 Ingleson ..... F01D 11/22 415/127
4,127,357 A * 11/1978 Patterson ..... F01D 11/22 415/116
4,714,404 A 12/1987 Lardellier
5,056,988 A * 10/1991 Corsmeier ..... F01D 11/22 415/126
7,096,657 B2 * 8/2006 Mahoney ..... F01D 17/162 415/150
7,922,445 B1 4/2011 Pankey et al.
(Continued)

FOREIGN PATENT DOCUMENTS

| | | | | |
|---|---|---|---|---|
| DE | 102007056895 | * | 5/2009 | ..... F01D 11/22 |
| GB | 2108591 | | 5/1983 | |
| WO | 2011071422 | | 6/2011 | |

OTHER PUBLICATIONS

Extended European Search Report dated Oct. 18, 2016 in European Application No. 16169615.8.

*Primary Examiner* — Woody Lee, Jr.
*Assistant Examiner* — Brian O Peters
(74) *Attorney, Agent, or Firm* — Snell & Wilmer L.L.P.

(57) ABSTRACT

A blade outer air seal (BOAS) assembly is provided. The BOAS assembly may comprise an outer case, a first support arm, a second support arm, a control rod, a blade outer air seal (BOAS), and a unison ring. The unison ring may be located radially inward of the outer case and in mechanical communication with the control rod. The BOAS may be configured to expand or contract in response to a rotation of the control rod. The first support arm may be fixed to the outer case. The second support arm may be fixed to the outer case. The control rod may be coupled to the first support arm and the second support arm, wherein the control rod may be configured to rotate about a control rod axis. The BOAS may comprise a first segment and a second segment.

20 Claims, 8 Drawing Sheets

(56) References Cited

U.S. PATENT DOCUMENTS

| | | | | |
|---|---|---|---|---|
| 8,177,490 | B2 * | 5/2012 | Bouru | F01D 17/162<br>415/150 |
| 8,534,996 | B1 | 9/2013 | Pankey et al. | |
| 9,598,975 | B2 * | 3/2017 | Uskert | F01D 11/24 |

* cited by examiner

CAM-FOLLOWER ACTIVE CLEARANCE CONTROL

FIELD

The present disclosure relates to gas turbine engines, and more specifically, to a system for control over blade tip clearance between a turbine blade and a blade outer air seal (BOAS).

BACKGROUND

Gas turbine engines generally include a compressor to pressurize inflowing air, a combustor to burn a fuel in the presence of the pressurized air, and a turbine to extract energy from the resulting combustion gases. The turbine may include multiple rotatable turbine blade arrays separated by multiple stationary vane arrays. A turbine blade array may be disposed radially inward of an annular blade outer air seal (BOAS). Minimal blade tip clearance between turbine blades and a BOAS is associated with maximum efficiency. Due to thermal expansion and centrifugal force, clearance between the turbine blade array and the BOAS may be large.

SUMMARY

A blade outer air seal (BOAS) assembly is provided. The BOAS assembly may comprise an outer case, a first support arm, a second support arm, a control rod, a blade outer air seal (BOAS), and a unison ring. The unison ring may be located radially inward of the outer case and in mechanical communication with the control rod. The BOAS may be configured to expand or contract in response to a rotation of the control rod. The first support arm may be fixed to the outer case. The second support arm may be fixed to the outer case. The control rod may be coupled to the first support arm and the second support arm. The control rod may be configured to rotate about a control rod axis. The BOAS may comprise a first segment and a second segment.

A gas turbine engine is provided. The gas turbine engine may comprise an outer case, a first support arm, a second support arm, a control rod, a blade outer air seal (BOAS), and a unison ring. The unison ring may be located radially inward of the outer case and in mechanical communication with the control rod. The BOAS may be configured to expand or contract in response to a rotation of the control rod. The first support arm may be fixed to the outer case. The second support arm may be fixed to the outer case. The control rod may be coupled to the first support arm and the second support arm. The control rod may be configured to rotate about a control rod axis. The BOAS may comprise a first segment and a second segment.

A method for controlling a BOAS assembly is provided. The method may comprise translating, by an actuator, an actuating rod, wherein the actuator is coupled to an outer case. A pivot may pivot in response to the translating of the actuating rod. A unison ring may rotate in response to the pivoting of the pivot. A control rod, wherein the control rod is fixed to the outer case, may rotate in response to the rotating of the unison ring. A gap may vary in response to the rotating of the control rod, wherein the gap is located between a blade outer air seal (BOAS) and a turbine blade.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
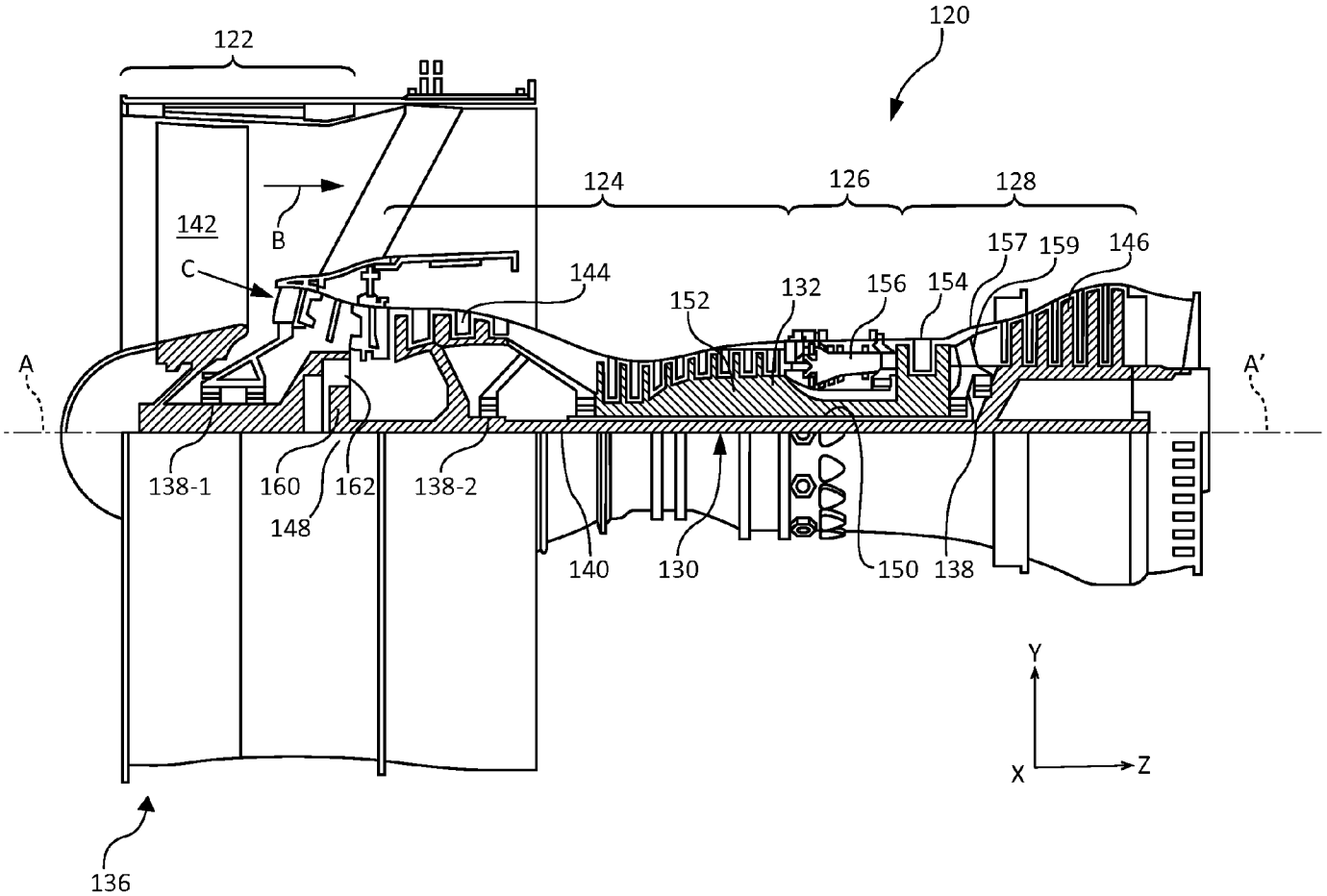
FIG. 1 illustrates an exemplary gas turbine engine, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein. Thus, the detailed description herein is presented for purposes of illustration only and not of limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step.

Also, any reference to attached, fixed, connected or the like may include permanent, removable, temporary, partial, full and/or any other possible attachment option. Additionally, any reference to without contact (or similar phrases) may also include reduced contact or minimal contact. Moreover, surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

Jet engines often include one or more stages of blade outer air seal (BOAS) and/or vane assemblies. Each BOAS and/or vane assembly may comprise one or more sections or segments. These sections or segments may be referred to collectively as a BOAS. In various embodiments the BOAS are detachably coupled to an axially adjacent vane assembly, while in further embodiments, the BOAS are integral with an axially adjacent vane assembly. In either case, and without loss of generality, the present disclosure refers to both as a BOAS. In addition, the BOAS may also be referred to as a static turbine shroud. A BOAS may be disposed radially outward of a turbine blade and/or a plurality of turbine blades relative to an engine axis. A BOAS may thus comprise an annular structure comprising a plurality of BOAS segments, each BOAS segment disposed radially about one or more of a plurality of turbine blades, each of which may rotate, during operation, within the BOAS assembly.

During operation of a gas turbine engine, turbine blades may rotate about an engine axis within the BOAS assembly as previously described. During operation, it may be desirable to minimize the gap between turbine blade tips and the BOAS assembly to minimize engine component temperatures and to increase the efficiency of the turbine section of a gas turbine engine. However, due to thermal expansion and centrifugal force from the rotating turbine blades, the turbine blades may elongate radially outward towards the BOAS assembly, thereby decreasing turbine blade clearance. Tip strike may occur when a turbine blade tip strikes or rubs against the BOAS assembly. In order to prevent tip strike and to increase efficiency, an active control system may be provided in order to control the radial position of the BOAS within the gas turbine engine, thereby minimizing blade tip clearance and preventing turbine blade strike at the same time. Accordingly, engine temperatures may be stabilized and turbine section efficiency may increase. Moreover, the radial position of the BOAS may be changed in accordance with engine operating conditions, thereby allowing maintenance of advantageous blade tip clearance despite the mode of engine operation.

In various embodiments and with reference to FIG. 1, a gas turbine engine 120 is provided. Gas turbine engine 120 may be a two-spool turbofan that generally incorporates a fan section 122, a compressor section 124, a combustor section 126 and a turbine section 128. Alternative engines may include, for example, an augmentor section among other systems or features. In operation, fan section 122 can drive air along a bypass flow-path B while compressor section 124 can drive air along a core flow-path C for compression and communication into combustor section 126 then expansion through turbine section 128. Although depicted as a turbofan gas turbine engine 120 herein, it should be understood that the concepts described herein are not limited to use with turbofans as the teachings may be applied to other types of turbine engines including three-spool architectures.

Gas turbine engine 120 may generally comprise a low speed spool 130 and a high speed spool 132 mounted for rotation about an engine central longitudinal axis A-A' relative to an engine static structure 136 via one or more bearing systems 138 (shown as bearing system 138-1 and bearing system 138-2 in FIG. 1). It should be understood that various bearing systems 138 at various locations may alternatively or additionally be provided including, for example, bearing system 138, bearing system 138-1, and bearing system 138-2.

Low speed spool 130 may generally comprise an inner shaft 140 that interconnects a fan 142, a low pressure (or first) compressor section 144 and a low pressure (or first) turbine section 146. Inner shaft 140 may be connected to fan 142 through a geared architecture 148 that can drive fan 142 at a lower speed than low speed spool 130. Geared architecture 148 may comprise a gear assembly 160 enclosed within a gear housing 162. Gear assembly 160 couples inner shaft 140 to a rotating fan structure. High speed spool 132 may comprise an outer shaft 150 that interconnects a high pressure compressor ("HPC") 152 (e.g., a second compressor section) and high pressure (or second) turbine section 154. A combustor 156 may be located between HPC 152 and high pressure turbine 154. A mid-turbine frame 157 of engine static structure 136 may be located generally between high pressure turbine 154 and low pressure turbine 146. Mid-turbine frame 157 may support one or more bearing systems 138 in turbine section 128. Inner shaft 140 and outer shaft 150 may be concentric and rotate via bearing systems 138 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 144 then HPC 152, mixed and burned with fuel in combustor 156, then expanded over high pressure turbine 154 and low pressure turbine 146. Mid-turbine frame 157 includes airfoils 159 which are in the core airflow path. Low pressure turbine 146 and high pressure turbine 154 rotationally drive the respective low speed spool 130 and high speed spool 132 in response to the expansion.

Gas turbine engine 120 may be, for example, a high-bypass geared aircraft engine. In various embodiments, the bypass ratio of gas turbine engine 120 may be greater than about six (6). In various embodiments, the bypass ratio of gas turbine engine 120 may be greater than ten (10). In various embodiments, geared architecture 148 may be an epicyclic gear train, such as a star gear system (sun gear in meshing engagement with a plurality of star gears supported by a carrier and in meshing engagement with a ring gear) or other gear system. Geared architecture 148 may have a gear reduction ratio of greater than about 2.3 and low pressure turbine 146 may have a pressure ratio that is greater than about 5. In various embodiments, the bypass ratio of gas turbine engine 120 is greater than about ten (10:1). In various embodiments, the diameter of fan 142 may be significantly larger than that of the low pressure compressor 144, and the low pressure turbine 146 may have a pressure ratio that is greater than about 5:1. Low pressure turbine 146 pressure ratio may be measured prior to inlet of low pressure turbine 146 as related to the pressure at the outlet of low pressure turbine 146 prior to an exhaust nozzle. It should be understood, however, that the above parameters are exemplary of various embodiments of a suitable geared architecture engine and that the present disclosure contemplates other gas turbine engines including direct drive turbofans.

Figure 2A:
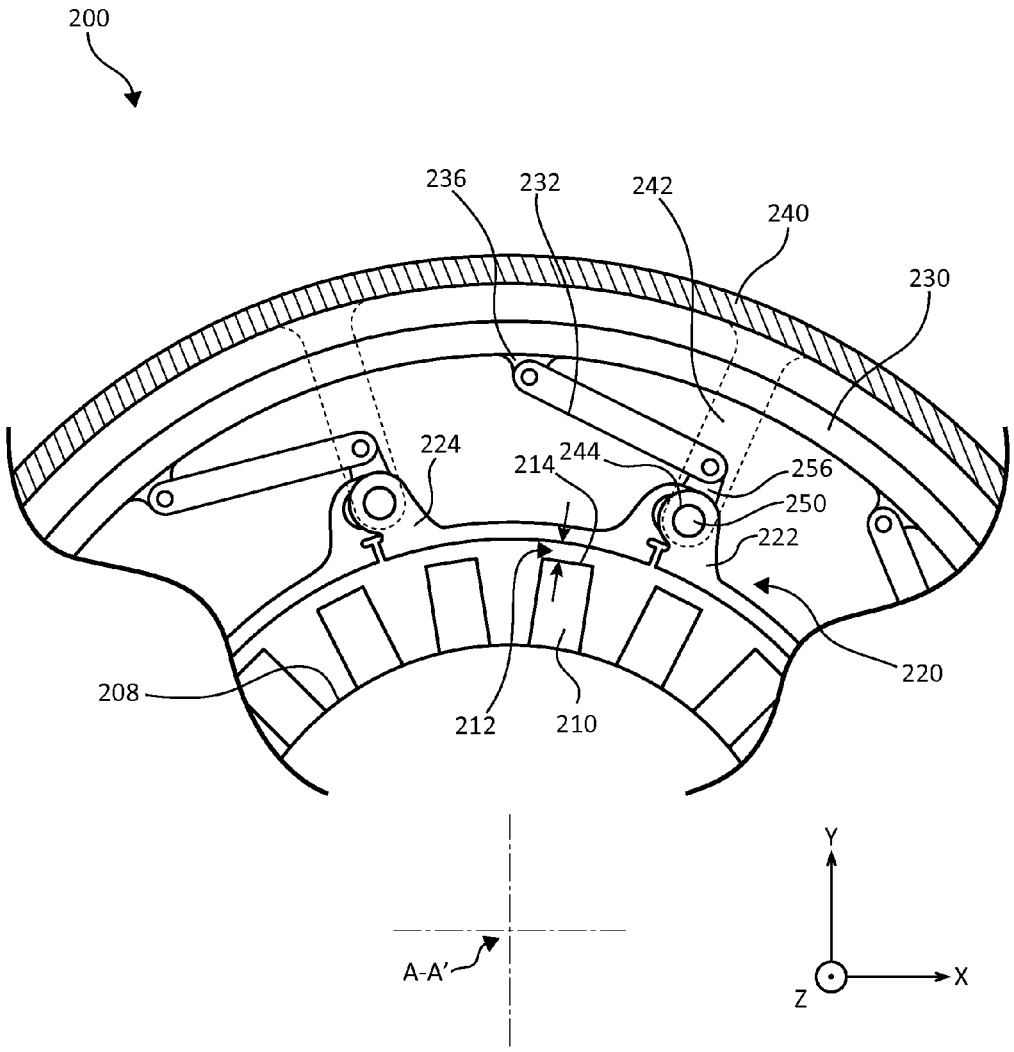
FIG. 2A illustrates a cross section view of a turbine section of a gas turbine engine, in accordance with various embodiments.

In various embodiments and with reference to FIG. 2A, turbine section 128 (with momentary reference to FIG. 1) may include BOAS assembly 200. BOAS assembly 200 may include outer case 240, unison ring 230, and BOAS 220. Unison ring 230 may be located radially inward of outer case 240. BOAS 220 may be located radially inward of unison ring 230. Turbine section 128 may further include a plurality of turbine blades, such as turbine blade 210, located radially inward of BOAS 220, each extending radially outward from turbine engine axis A-A'. Turbine blade 210 may be attached to a rotor disk 208. As previously mentioned, turbine blade 210 may be configured to rotate with rotor disk 208 about engine axis A-A'. The radially outward portion of turbine blade 210 (referred to herein as "turbine blade tip" 214) may be in close proximity to BOAS 220. A gap 212 may exist between turbine blade tip 214 and BOAS 220. Gap 212 may be referred to as blade tip clearance. Accordingly, blade tip clearance may be defined as the radial distance of gap 212 between turbine blade tip 214 and BOAS 220.

BOAS 220 may comprise a plurality of BOAS segments, such as segment 222, as described above. Each segment may couple to an adjacent segment to form annular BOAS 220 that is concentrically situated about the plurality of turbine blades. For example, segment 222 may be coupled to adjacent segment 224. Segment 224 may be similar to segment 222. A plurality of support arms, such as first support arm 242, may extend radially inwards towards engine axis A-A' from outer case 240. First support arm 242 may be fixed to outer case 240. Aperture 244 may be disposed on first support arm 242. Control rod 250 may be configured to be inserted into aperture 244 (along the z direction), thereby coupling first support arm 242 to control rod 250. Accordingly, control rod 250 may be fixed to outer case 240. Control rod 250 may be configured to rotate within aperture 244. Control rod 250 may include rod arm 256. Rod arm 256 may be fixed to control rod 250. Segment 222 may be configured to attach to control rod 250. A plurality of unison ring lugs, such as unison ring lug 236, may be disposed on the radially inward surface of unison ring 230. A link 232 may couple rod arm 256 to unison ring lug 236. Link 232 may be coupled to unison ring lug 236. Link 232 may be coupled to rod arm 256.

Figure 2B:
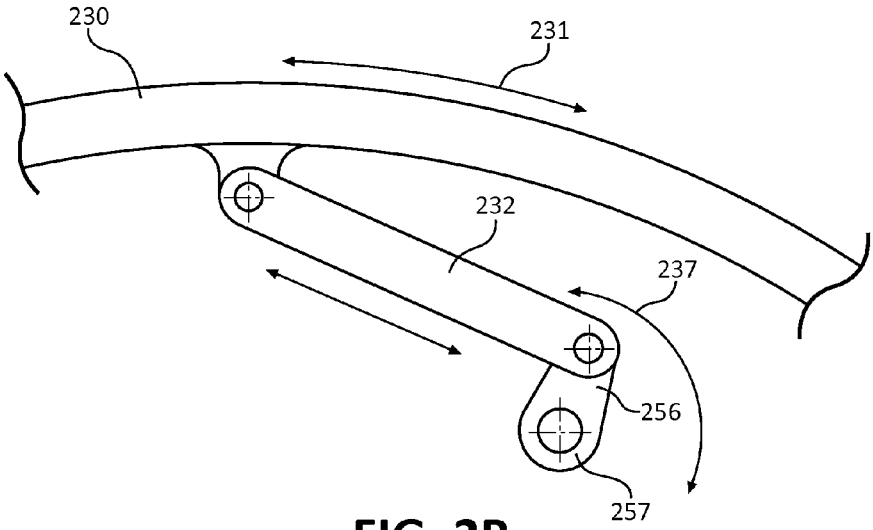
FIG. 2B illustrates a schematic view of a unison ring assembly, in accordance with various embodiments.

In various embodiments and with reference to FIG. 2B, unison ring 230 may be configured to rotate about an engine axis as illustrated by arrow 231. Rod arm 256 may be configured to rotate about control rod axis 257 as illustrated by arrow 237. Rod arm 256 may be configured to rotate about control rod axis 257 in response to unison ring 230 rotating about an engine axis. For example, unison ring 230 may rotate in the clockwise direction, whereby at least a portion of link 232 may rotate with unison ring 230 which may cause rod arm 256 to rotate about control rod axis 257.

Figure 3A:
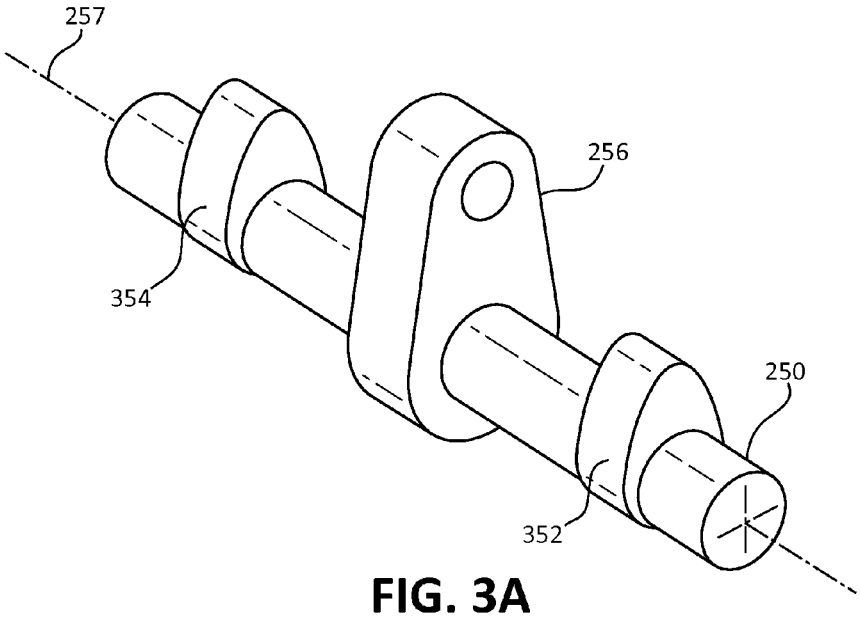
FIG. 3A illustrates an isometric view of a control rod, in accordance with various embodiments.
Figure 3B:
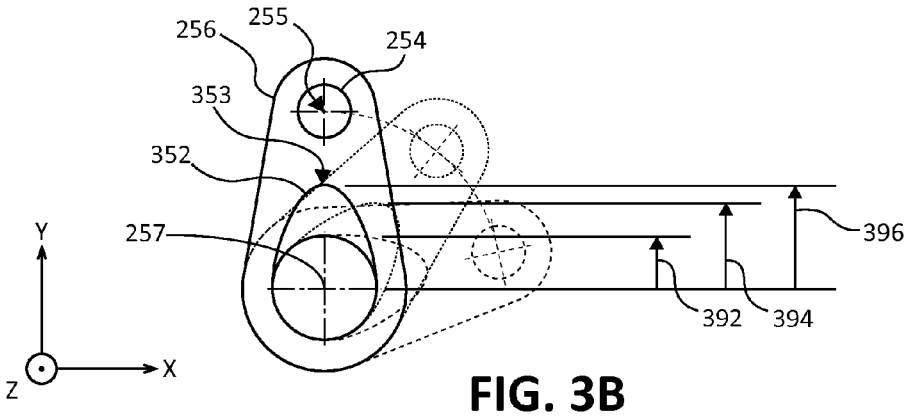
FIG. 3B illustrates an aft view of a control rod rotated in various position, in accordance with various embodiments.

With respect to FIGS. 3A-3B, elements with like element numbering as depicted in FIGS. 2A-2B are intended to be the same and will not be repeated for the sake of clarity With reference to FIG. 3A, control rod 250 may include first cam 352 and second cam 354. In various embodiments, first cam 352 and second cam 354 may be fixed to control rod 250. In various embodiments, first cam 352 and second cam 354 may be integral to control rod 250. Second cam 354 may be similar to first cam 352. Rod arm 256 may be located between first cam 352 and second cam 354. First cam 352 and second cam 354 may be configured to rotate about control rod axis 257 with control rod 250 in response to rod arm 256 rotating about control rod axis 257 as previously described.

With reference to FIG. 3B, an xyz axis is provided for ease of illustration. As previously mentioned, rod arm 256 may be configured to rotate about control rod axis 257. Aperture 254 may be disposed on rod arm 256. Aperture 254 may be used to couple link 232, with momentary reference to FIGS. 2A-2B, to rod arm 256. In various embodiments, a line from control rod axis 257 through centerline 255 of aperture 254 may point radially outwards from an engine axis. Accordingly, rod arm 256 may point in the radially outward direction. The radially outer edge 353 of first cam 352 may comprise a y-component distance 396 from control rod axis 257. As rod arm 256 rotates about control rod axis 257, the radially outer edge of first cam 352 may comprise a y-component distance 394 from control rod axis 257. Distance 394 may be less than distance 396. As rod arm 256 rotates even further about control rod axis 257, the radially outer edge of first cam 352 may comprise a y-component distance 392 from control rod axis 257. Distance 392 may be less than distance 394. Accordingly, the radially outer edge of first cam 352 may be moved radially inward and radially outward in response to rotation of rod arm 256.

With respect to FIGS. 4A-4H, elements with like element numbering as depicted in FIGS. 2A-3B are intended to be the same and will not be repeated for the sake of clarity.

Figure 4A:
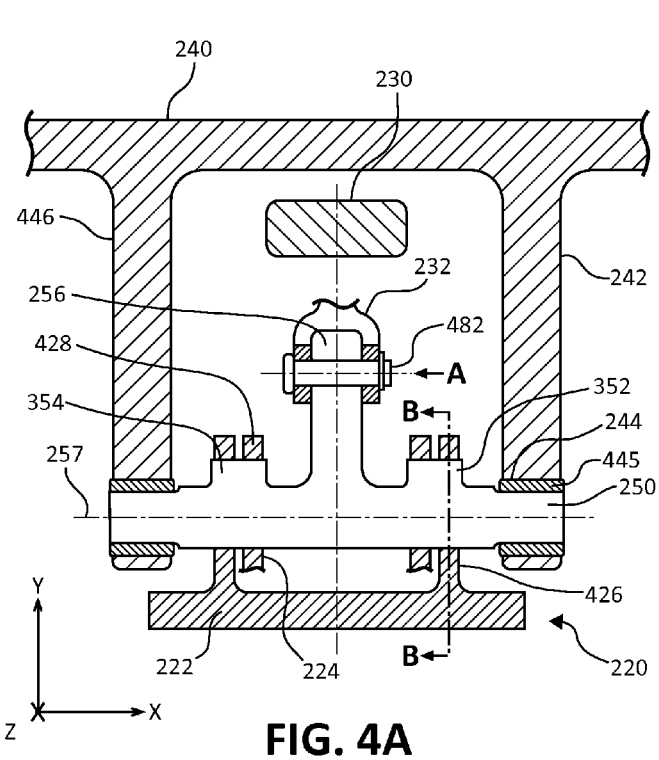
FIG. 4A illustrates a cross section view of a BOAS assembly, in accordance with various embodiments.

With reference to FIG. 4A, outer case 240 may be coupled to first support arm 242, as previously mentioned, and second support arm 446. Second support arm 446 may be similar to first support arm 242. Control rod 250 may be coupled to first support arm 242 and second support arm 446. A bushing 445 may be located within aperture 244. Bushing 445 may be configured to couple control rod 250 to first support arm 242. In various embodiments, a fastener 482 may be used to couple link 232 to rod arm 256. In various embodiments, segment 222 may be coupled to first cam 352 and second cam 354 via a plurality of first attachment features such as first attachment feature 426. In various embodiments, segment 224 may be coupled to first cam 352 and second cam 354 via a plurality of second attachment features such as second attachment feature 428.

Figure 4B:
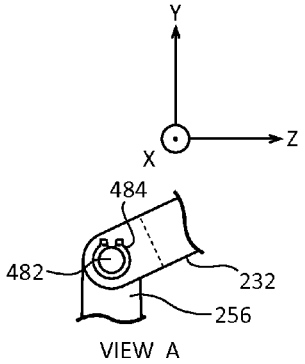
FIG. 4B illustrates an aft view of a rod arm connection assembly, in accordance with various embodiments.

With reference to FIG. 4B, a snap ring 484 may be placed around fastener 482. Snap ring 484 may secure fastener 482 to link 232.

Figure 4C:
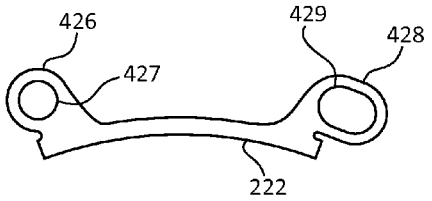
FIG. 4C illustrates a BOAS segment, in accordance with various embodiments.
Figure 4D:
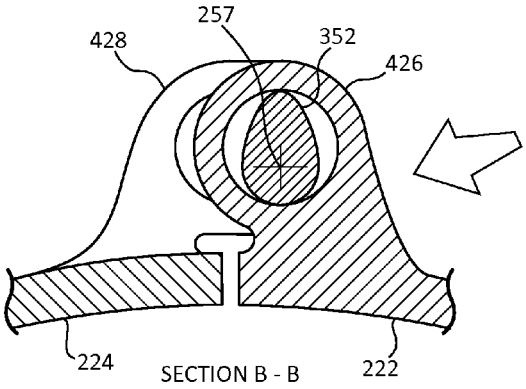
FIG. 4D illustrates a first cam coupled to a plurality of BOAS segments, in accordance with various embodiments.

In various embodiments and with reference to FIG. 4C and FIG. 4D, segment 222 may include first attachment feature 426 and second attachment feature 428. In various embodiments, aperture 427 may be disposed on first attachment feature 426. In various embodiments, aperture 427 may be circular. The diameter of aperture 427 may be complementary to the maximum diameter of first cam 352. In various embodiments, aperture 429 may be disposed on second attachment feature 428. In various embodiments, aperture 429 may be ovular in geometry. First attachment feature 426 may be configured to slide over first cam 352 into an installed position. In various embodiments, second attachment feature 428 may be configured to slide over first cam 352 into an installed position. As previously described, as first cam 352 rotates about control rod axis 257, the radially outer edge of first cam 352 may be moved radially inward and radially outward, thereby moving segment 222 radially inward and radially outward according to the radially outer edge of first cam 352. Accordingly, the radial position of segment 222 may be adjusted by rotating first cam 352 about control rod axis 257, thereby providing control over turbine blade tip clearance. Accordingly, the radial position of a BOAS may be adjusted by rotating first cam 352 about control rod axis 257.

Figure 4F:
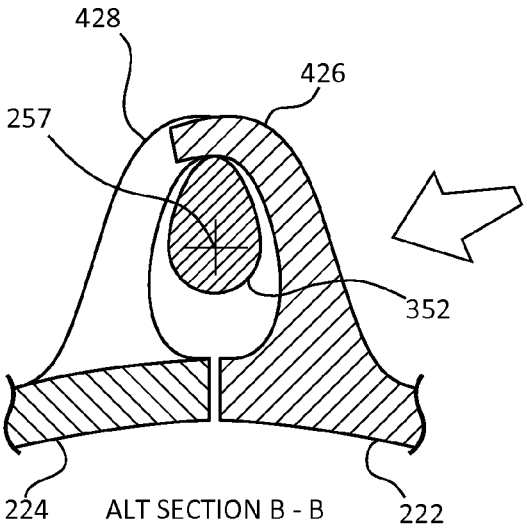
FIG. 4F illustrates a first cam coupled to a plurality of BOAS segments with hook attachment features, in accordance with various embodiments.
Figure 4E:
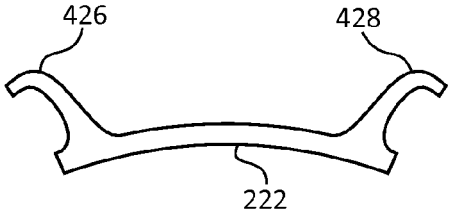
FIG. 4E illustrates a BOAS segment with hook attachment features, in accordance with various embodiments.

In various embodiments and with reference to FIG. 4E and FIG. 4F, first attachment feature 426 may comprise a hook. In various embodiments, second attachment feature 428 may comprise a hook. In various embodiments, first attachment feature 426 of segment 222 may be placed over first cam 352 into an installed position. In various embodiments, second attachment feature 428 of segment 224 may be placed over first cam 352 into an installed position.

Figure 4H:
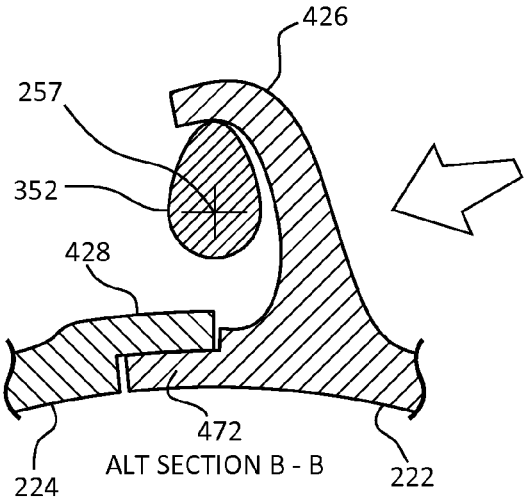
FIG. 4H illustrates a first cam coupled to a plurality of BOAS segments with a hook attachment feature and a tab attachment feature, in accordance with various embodiments.
Figure 4G:
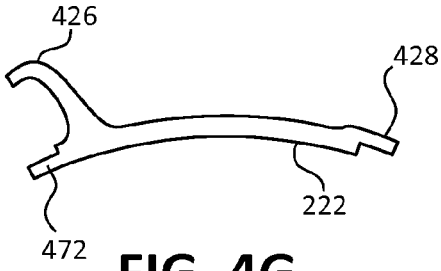
FIG. 4G illustrates a BOAS segment with a hook attachment feature and a tab attachment feature, in accordance with various embodiments.

In various embodiments and with reference to FIG. 4G and FIG. 4H, first attachment feature 426 may comprise a hook. In various embodiments, first attachment feature 426 may further comprise a support platform 472. Support platform 472 may be configured to be coupled to an adjacent BOAS segment. Support platform 472 may be configured to support an adjacent BOAS segment. In various embodiments, second attachment feature 428 may comprise a tab. The geometry of second attachment feature 428 may be complementary to the geometry of support platform 472. In various embodiments, first attachment feature 426 of segment 222 may be configured to couple segment 222 to first cam 352 into an installed position. For example, first attachment feature 426 may partially wrap around a radially outer surface of first cam 352. In various embodiments, second attachment feature 428 of segment 224 may be configured to couple segment 224 to segment 222 via support platform 472 into an installed position. For example, second attachment feature 428 may be located adjacent to a radially outer surface of support platform 472 when in the installed position. In various embodiments, the inner surface of segment 222 and the inner surface of segment 224 may be parallel to one another when in the installed position. In various embodiments, segment 224 may be configured to move radially inward and radially outward with segment 222.

Figure 5A:
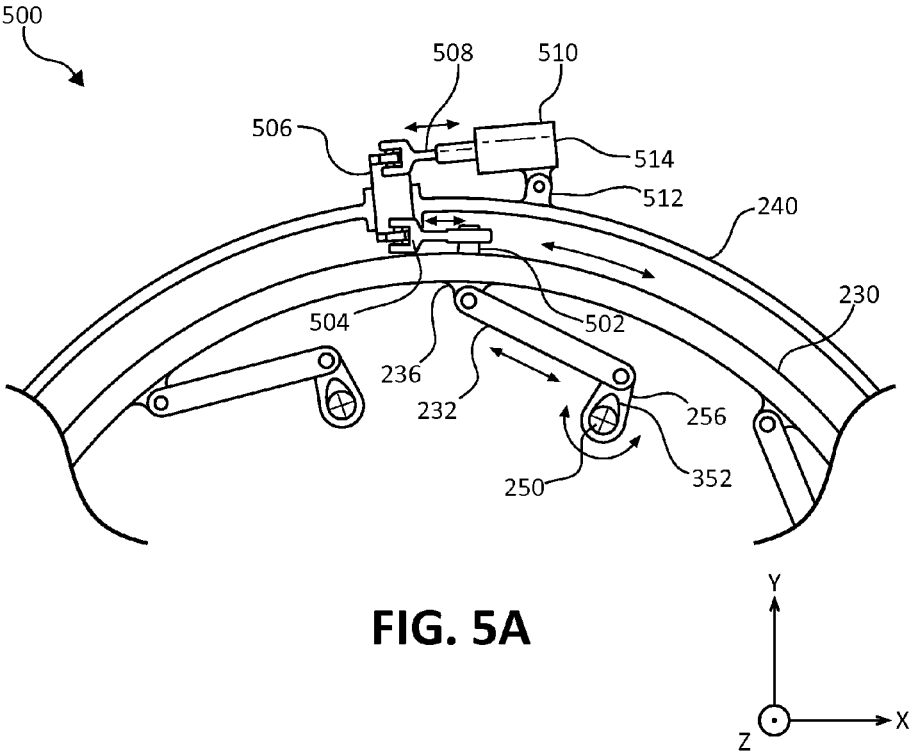
FIG. 5A illustrates an aft view of a BOAS control system, in accordance with various embodiments.
Figure 5B:
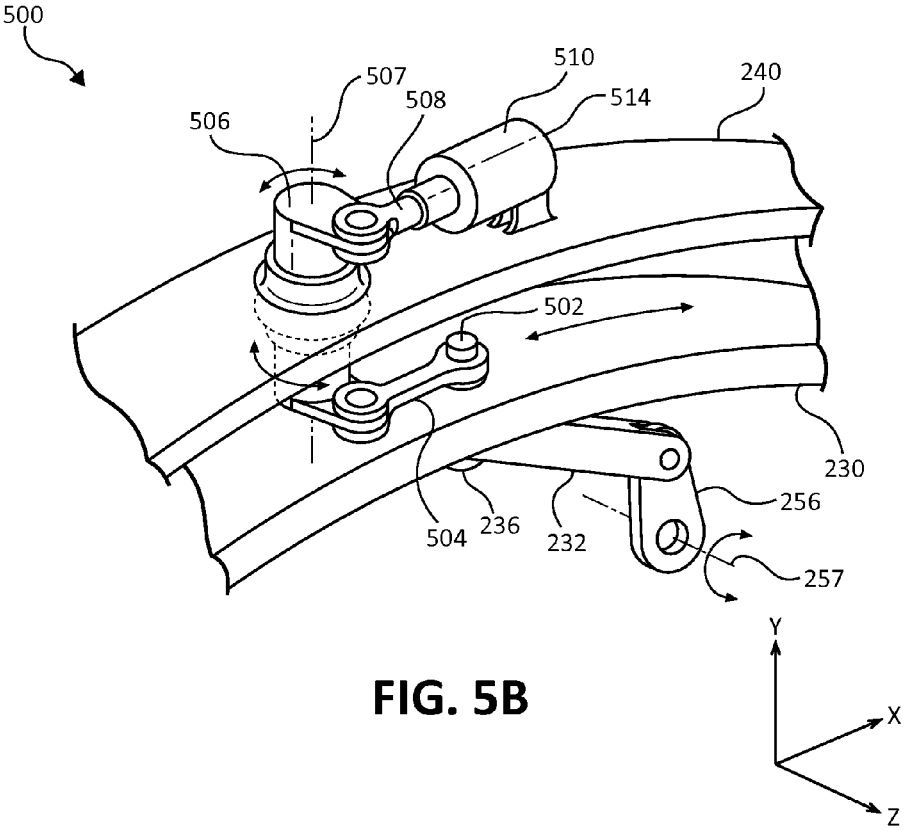
FIG. 5B illustrates a perspective view of a BOAS control system, in accordance with various embodiments.

With respect to FIGS. 5A-5B, elements with like element numbering as depicted in FIGS. 2A-4H are intended to be the same and will not be repeated for the sake of clarity.

With reference to FIG. 5A, BOAS assembly 500 may be similar to BOAS assembly 200 (with momentary reference to FIG. 2A and FIG. 4A). BOAS assembly 500 may include actuator 510. Outer case 240 may include third case lug 512. Third case lug 512 may be located on the outer surface of outer case 240. Third case lug 512 may be configured to couple outer case 240 to an actuator 510. Actuator 510 may be a hydraulic actuator. Actuator 510 may configured to use fuel pressure to actuate. Actuator 510 may be a linear actuator. Actuator 510 may be coupled to an actuating rod 508. Actuating rod 508 may be configured to translate into and out of actuator 510. Actuating rod 508 may be coupled to pivot 506. Pivot 506 may be fixed to outer case 240. Pivot 506 may be coupled to connecting rod 504. Connecting rod 504 may be coupled to unison ring pin 502. Unison ring pin 502 may be fixed to unison ring 230.

In various embodiments and with reference to FIG. 5B, actuator 510 may translate actuating rod 508 out actuator 510, whereby actuating rod may rotate pivot 506 about pivot axis 507, whereby pivot 506 may rotate unison ring 230 about an engine axis via connecting rod 504. Accordingly, the rotation of unison ring 230 may cause a BOAS to radially expand or contract as previously described.

In various embodiments and with reference now to FIG. 5A and FIG. 5B, actuator 510 may further comprise a linear variable differential transformer (LVDT) 514. LVDT 514 may be in communication with a full authority digital engine control (FADEC) of an aircraft. LVDT 514 may monitor the position of actuating rod 508. The position of actuating rod 508 may correspond to a radial position of a BOAS. Accordingly, LVDT 514 may control and/or monitor the radial position of a BOAS via the linear position of actuating rod 508.

LVDT 514 may be configured to use transient aircraft data. In various embodiments, flight data such as altitude, speed, engine temperature, and throttle position of an aircraft may be used to determine BOAS placement. In various embodiments, the BOAS may be configured to rapidly expand or contract. In various embodiments, the BOAS may be configured to expand or contract due to a change in gravitational acceleration of an aircraft.

Figure 6:
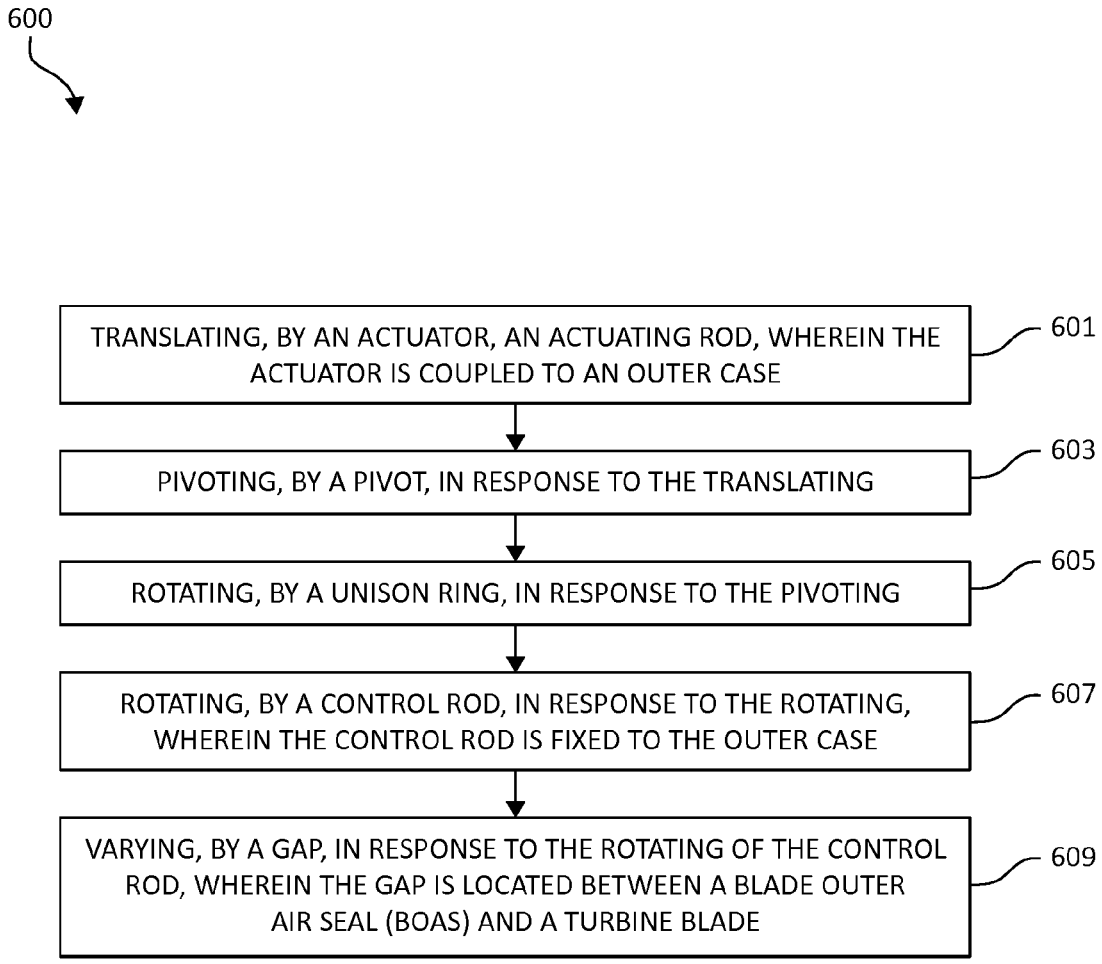
FIG. 6 illustrates a method for controlling a BOAS assembly, in accordance with various embodiments.

With reference to FIG. 6, a method for controlling a BOAS assembly is described herein, in accordance with various embodiments. The method 600 may comprise translating, by an actuator, an actuating rod, wherein the actuator is coupled to an outer case in step 601. A pivot may pivot in response to the translating of the actuating rod in step 603. A unison ring may rotate in response to the pivoting of the pivot in step 605. A control rod, wherein the control rod is fixed to the outer case, may rotate in response to the rotating of the unison ring in step 607. A gap may vary in response to the rotating of the control rod, wherein the gap is located between a blade outer air seal (BOAS) and a turbine blade in step 609. The control rod may include a cam, wherein the BOAS is coupled to the cam, wherein in response to the rotating of the control rod, the distance between a centerline of an engine and the outer edge of the cam varies, wherein in response to the varying, the BOAS is displaced in a radial direction.

In various embodiments, and with further reference to FIG. 2A and FIG. 5A, step 601 may include actuator 510, wherein actuator 510 translates actuating rod 508, wherein actuator 510 is coupled to outer case 240. Step 603 may include pivot 506, wherein pivot 506 pivots in response to actuator 510 translating actuating rod 508. Step 605 may include unison ring 230, wherein unison ring 230 rotates in response to the pivoting of pivot 506. Step 607 may include control rod 250, wherein control rod 250 may rotate in response to the rotation of unison ring 230, wherein control rod 250 is fixed to outer case 240. Step 609 may include blade outer seal (BOAS) 220 and turbine blade 210, wherein gap 212 may vary in response to the rotating of control rod 250 as previously described.

Figure 7:
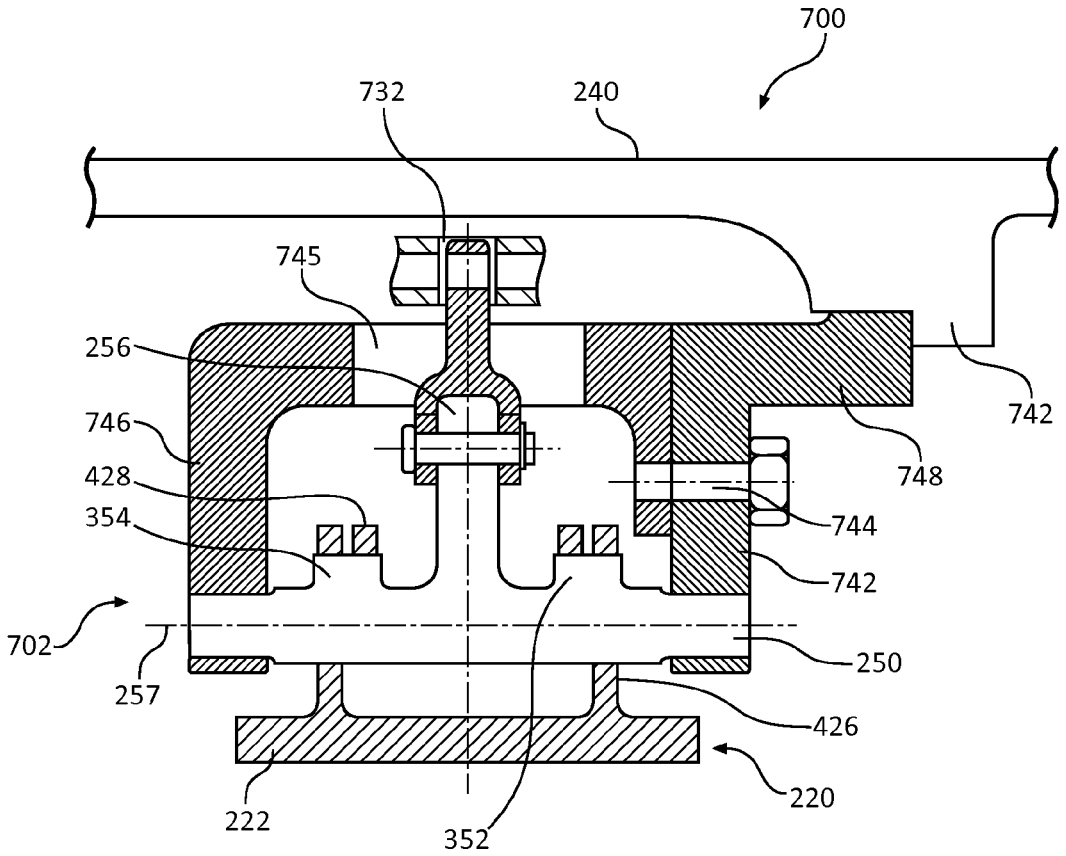
FIG. 7 illustrates a cross section view of a BOAS assembly with a detachable BOAS support structure, in accordance with various embodiments.

With respect to FIG. 7, elements with like element numbering as depicted in FIG. 4A are intended to be the same and will not be repeated for the sake of clarity.

In various embodiments, and with reference to FIG. 7, a BOAS assembly 700 is illustrated with a detachable BOAS support structure 702. In various embodiments, support structure 702 may include first support arm 742 and second support arm 746. In various embodiments, support structure 702 may further include fastener 744. In various embodiments, first support arm 742 may be integral to second support arm 746. In various embodiments, first support arm 742 and second support arm 746 may be coupled via one or more fasteners 744. In various embodiments, first support arm 742 and second support arm 746 may be coupled via a bracket. In various embodiments, first support arm 742 and second support arm 746 may be coupled via commonly available means. In various embodiments, support structure 702 may be installed as a sub-assembly. For example, a sub-assembly including support structure 702 may further include control rod 250 and/or link 232 which may be installed as a sub-assembly. With momentary reference to FIG. 4A, first support arm 742 may be similar to first support arm 242. Second support arm 746 may be similar to second support arm 446. In various embodiments, sub-assembly 702 may detachably fixed to outer case 240 via support case attachment feature 748 and outer case attachment feature 742. First support arm 742 may be fixed to outer case 240 via support case attachment feature 748. Second support arm 746 may be fixed to outer case 240 via first support arm 742. Outer case attachment feature 742 may be integral to outer case 240. Support case attachment feature 748 may be integral to first support arm 742. In various embodiments, outer case attachment feature 742 may be coupled to support case attachment feature 748 via any various attachment method known to a person having ordinary skill in the art. In various embodiments, outer case attachment feature 742 may be coupled to support case attachment feature 748 via a spline joint. For example, one or more male splines on support case attachment feature 748 may mate to one or more female splines in outer case attachment feature 742. In various embodiments, outer case attachment feature 742 may be coupled to support case attachment feature 748 via one or more fasteners such as one or more bolts, rivets, or other suitable fasteners and/or combinations of the same, for example. In various embodiments, second support arm 746 may comprise aperture 745, Aperture 745 may be configured to allow link 232 to rotate about rod arm 256. Second support arm may be located radially inwards of unison ring 230. In various embodiments, at least a portion of link 232 may be located within aperture 745.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A blade outer air seal (BOAS) assembly, comprising:
an outer case;
a first support arm fixed to the outer case;
a second support arm fixed to the outer case;
a control rod coupled to the first support arm and the second support arm, wherein the control rod is configured to rotate about a control rod axis;
a unison ring located radially inward of the outer case and in mechanical communication with the control rod, the unison ring located between the first support arm and the second support arm;
a rod arm extending from the control rod, the rod arm located between the first support arm and the second support arm; and
a blade outer air seal (BOAS), comprising:
a first segment;
wherein the BOAS is configured to at least one of expand or contract in response to a rotation of the control rod.

2. The BOAS assembly of claim 1, further comprising:
a link coupled between the unison ring and the rod arm, wherein a rotation of the unison ring causes the link to rotate the control rod,
wherein the control rod comprises at least one of a first cam and a second cam, wherein the rod arm is coupled to the unison ring via the link, wherein the rod arm is configured to rotate about control rod axis in response to the rotation of the unison ring.

3. The BOAS assembly of claim 2, wherein the BOAS further comprises a second segment, wherein at least one of the first segment or the second segment are coupled to at least one of the first cam or the second cam, wherein in response to the rotation of the control rod, the BOAS is configured to at least one of expand or contract.

4. The BOAS assembly of claim 1, wherein the BOAS assembly further comprises a turbine blade located radially inward of the BOAS, wherein the BOAS and the turbine blade are separated by a gap, wherein the BOAS assembly is configured to at least one of increase or decrease a radial distance of the gap in response to a rotation of the unison ring.

5. The BOAS assembly of claim 1, wherein the BOAS assembly further comprises an actuator coupled to an outer surface of the outer case, wherein the actuator includes an actuating rod, wherein the actuating rod is configured to translate into or out of the actuator.

6. The BOAS assembly of claim 5, wherein the outer case further comprises a pivot fixed to the outer case, wherein the actuator is coupled to the pivot, wherein the pivot is coupled to a unison ring pin via a connecting rod, the unison ring pin being located on the outer surface of the unison ring.

7. The BOAS assembly of claim 5, wherein the unison ring is configured to rotate about an engine axis in response to the actuating rod translating at least one of into or out the actuator.

8. The BOAS assembly of claim 5, wherein the actuator includes a linear variable differential transformer (LVDT), wherein the LVDT is configured to monitor a position of the actuating rod.

9. The BOAS assembly of claim 3, wherein at least one of first segment or the second segment comprise a first attachment feature and a second attachment feature, wherein at least one of a first attachment feature or a second attachment feature include at least one of a hook, circular aperture, ovular aperture, tab, or a support platform.

10. A gas turbine engine, comprising:

an outer case;

a first support arm fixed to the outer case;

a second support arm fixed to the outer case;

a control rod coupled to the first support arm and the second support arm, the control rod configured to rotate about a control rod axis;

a unison ring located radially inward of the outer case and in mechanical communication with the control rod, the unison ring located between the first support arm and the second support arm;

a rod arm extending from the control rod, the rod arm located between the first support arm and the second support arm; and a blade outer air seal (BOAS), comprising:

a first segment;

wherein the BOAS is configured to expand or contract in response to a rotation of the control rod.

11. The gas turbine engine of claim 10, further comprising:

a link coupled between the unison ring and the rod arm, wherein a rotation of the unison ring causes the link to rotate the control rod, wherein the control rod comprises at least one of a first cam and a second cam, wherein the rod arm is coupled to the unison ring via the link, wherein the rod arm is configured to rotate about control rod axis in response to the rotation of the unison ring.

12. The gas turbine engine of claim 11, wherein the BOAS further comprises a second segment, wherein at least one of the first segment or the second segment are coupled to at least one of the first cam or the second cam, wherein response to the rotation of the control rod, the BOAS is configured to at least one of expand or contract.

13. The gas turbine engine of claim 10, wherein the BOAS assembly further comprises a turbine blade located radially inward of the BOAS, wherein the BOAS and the turbine blade are separated by a gap, wherein the BOAS assembly is configured to at least one of increase or decrease a radial distance of the gap in response to a rotation of the unison ring.

14. The gas turbine engine of claim 10, wherein the BOAS assembly further comprises an actuator coupled to an outer surface of the outer case, wherein the actuator includes an actuating rod, wherein the actuating rod is configured to translate into or out of the actuator.

15. The gas turbine engine of claim 14, wherein the outer case further comprises a pivot fixed to the outer case, wherein the actuator is coupled to the pivot, wherein the pivot is coupled to a unison ring pin via a connecting rod, the unison ring pin being located on the outer surface of the unison ring.

16. The gas turbine engine of claim 14, wherein the unison ring is configured to rotate about an engine axis in response to the actuating rod translating into or out of the actuator.

17. The gas turbine engine of claim 14, wherein the actuator includes a linear variable differential transformer (LVDT), wherein the LVDT is configured to monitor a position of the actuating rod.

18. The gas turbine engine of claim 12, wherein at least one of first segment and the second segment comprise a first attachment feature and a second attachment feature, wherein a at least one of first attachment feature and the second attachment feature include at least one of a hook, circular aperture, ovular aperture, tab, or support platform.

19. A method for controlling a blade outer air seal (BOAS) assembly comprising:

translating, by an actuator, an actuating rod, wherein the actuator is coupled between a first support arm of an outer case and a second support arm of the outer case;

pivoting, by the actuating rod, a pivot, in response to the translating of the actuating rod;

rotating, by the pivot, a unison ring, in response to the pivoting of the pivot, the unison ring located radially inward of the outer case and in mechanical communication with the control rod, the unison ring located between the first support arm and the second support arm;

driving, by the unison ring, a link, in response to the rotating of the unison ring;

rotating, by the link, a control rod, in response to the driving of the link, wherein the control rod is coupled to the outer case; and varying a gap in response to the rotating of the control rod, wherein the gap is located between a BOAS and a turbine blade.

20. The method of claim 19, wherein the control rod includes a cam, wherein the BOAS is coupled to the cam, wherein in response to the rotating of the control rod, a distance between a centerline of an engine and an outer edge of the cam varies, wherein in response to the varying, the BOAS is displaced in a radial direction.

* * * * *